US010126063B2

(12) United States Patent
Bisson

(10) Patent No.: US 10,126,063 B2
(45) Date of Patent: Nov. 13, 2018

(54) RADIANT TUBULAR ELEMENT FOR INDUSTRIAL PLANTS AND SIMILAR

(76) Inventor: Massimiliano Bisson, Tezze sul Brenta (IT)

( * ) Notice: Subject to any disclaimer, the term of this patent is extended or adjusted under 35 U.S.C. 154(b) by 191 days.

(21) Appl. No.: 13/985,307

(22) PCT Filed: Feb. 14, 2011

(86) PCT No.: PCT/IB2011/050607
§ 371 (c)(1),
(2), (4) Date: Sep. 25, 2013

(87) PCT Pub. No.: WO2012/110852
PCT Pub. Date: Aug. 23, 2012

(65) Prior Publication Data

US 2014/0008048 A1 Jan. 9, 2014

(51) Int. Cl.

| | |
|---|---|
| ***F28F 1/42*** | (2006.01) |
| ***F28D 1/047*** | (2006.01) |
| ***C21D 9/00*** | (2006.01) |
| ***F23C 3/00*** | (2006.01) |
| ***F23D 14/12*** | (2006.01) |
| ***F27D 99/00*** | (2010.01) |
| ***F28F 1/10*** | (2006.01) |
| *C21D 1/34* | (2006.01) |

(52) U.S. Cl.
CPC ..... *F28D 1/047* (2013.01); *C21D 9/0006* (2013.01); *F23C 3/002* (2013.01); *F23D 14/12* (2013.01); *F27D 99/0035* (2013.01); *F28F 1/10* (2013.01); *C21D 1/34* (2013.01); *F23D 2900/14121* (2013.01); *F28F 1/426* (2013.01)

(58) Field of Classification Search
CPC ..... F28D 1/047; F28F 1/426; F23D 14/12; F23D 2300/14121; F23C 3/002; F27D 99/0035; C21D 9/0006
USPC ..... 165/177, 179, 906
See application file for complete search history.

(56) References Cited

U.S. PATENT DOCUMENTS

| | | | | |
|---|---|---|---|---|
| 2,642,858 A | | 6/1953 | Plesset et al. | |
| 3,187,798 A | | 6/1965 | Pokorny | |
| 4,209,064 A | * | 6/1980 | Cacalloro et al. | 165/170 |
| 4,467,780 A | * | 8/1984 | Ripka | F24H 3/105 126/110 R |
| 4,520,789 A | | 6/1985 | Rombouts | |
| 4,669,974 A | | 6/1987 | Sawada et al. | |
| 4,738,307 A | * | 4/1988 | Bentley | 165/133 |
| 4,751,964 A | * | 6/1988 | Borbely et al. | 165/179 |
| 4,971,137 A | * | 11/1990 | Thompson | 165/166 |
| 5,094,224 A | * | 3/1992 | Diesch | 126/110 R |
| 5,271,376 A | * | 12/1993 | Lu et al. | 126/110 R |
| 5,839,505 A | * | 11/1998 | Ludwig | F28D 1/0477 165/109.1 |

(Continued)

FOREIGN PATENT DOCUMENTS

GB 537290 6/1941

*Primary Examiner* — Leonard R Leo
(74) *Attorney, Agent, or Firm* — Tutunjian & Bitetto, P.C.

(57) ABSTRACT

Tubular radiant element for industrial plants and the like, made of a metal material resistant to high temperatures, including at least one vertical tubular portion, optionally at least a curved tubular portion, provided with a surface (S), including at least one radiation and stiffening means arranged on at least a portion of the surface (S) of the tubular radiant element.

8 Claims, 6 Drawing Sheets

(56) References Cited

U.S. PATENT DOCUMENTS

| | | | | |
|---|---|---|---|---|
| 6,371,201 | B1 * | 4/2002 | Evans | F28F 21/084 165/177 |
| 6,786,276 | B2 * | 9/2004 | Samy | F25B 39/022 165/109.1 |
| 6,938,688 | B2 * | 9/2005 | Lengauer, Jr. | F24H 3/105 165/170 |
| 2005/0067156 | A1 * | 3/2005 | Rottmann | F28F 3/04 165/177 |

* cited by examiner

RADIANT TUBULAR ELEMENT FOR INDUSTRIAL PLANTS AND SIMILAR

TECHNICAL FIELD OF THE INVENTION

The present invention relates to a tubular radiant element for industrial plants and the like, usable in the field of heat treatments of steel and/or other metals.

More in particular, the present invention relates to a tubular radiant element usable in the field of heat treatment furnaces, galvanisation and annealing lines for sheet tapes or plates and/or other products made of steel and/or other metals.

DESCRIPTION OF RELATED ART

In the field of steel heat treatments, in particular sheet, special types of radiant tubes are used, made of a material resistant to high temperatures, connected to burners capable of developing the temperatures required for the sheet passing, in the shape of a continuous tape, in the proximity of the same, to undergo the desired heat treatment.

The radiant tubes usually used in the field can take several shapes, the most common of which may be defined as a "I", "U", double "U", "W" or "M", single "P", "double P", double "M" shapes. Such radiant tubes are connected to a burner wherein the combustion takes place. Such tubes generally exhibit a portion wherein the flame and/or the fumes directly coming from the burner circulate, and optionally further portions wherein such combustion fumes can circulate. The combustion fumes cross the tube bringing it to such temperatures as to allow the heat exchange with the material to be treated by radiation.

Instead of being connected to a burner in which the combustion takes place, the known radiant tubes may also be heated by electrical resistors, positioned therein or outside the same tubes, which generate the temperatures required for the operation of such tubes.

Due to the resistance to high temperatures they must exhibit, the known radiant tubes are usually made by the process of sheet centrifugation and/or moulding and/or processing and subsequently, welded to any curves or flanges, always obtained from sheet and/or rolled sections or melts of any type, which allow obtaining the desired final shape.

However, the radiant tubes currently used have some drawbacks. In particular, since they have a substantially circular section, they exhibit a radiant surface defined and limited to the outer surface of the same tube.

Moreover, due to the high temperatures they are subject to, the known tubes may collapse and bend on themselves. In certain zones, this causes a consequent decrease of the radiant power of the same, causing a lack of homogeneity in the heat treatment for the steel products subject to such process and the immediate need to replace the radiant tube.

Moreover, the vibrations caused by the burner connected to the known radiant tubes cause a high mechanical stress to the same tube, causing possible breakage in the welding zones (such as, in particular, the burner coupling flanges and the "support" of the same radiant tube on the furnace casing side), in the material of which such tube is made, or twisting of the same tube.

The U.S. Pat. No. 2,642,858 discloses a fuel burning air heating device for motor vehicles, airplanes, and interiors of buildings of various sizes.

The patent GB 537290 discloses a radiant heating element adapted for installation in enameling furnaces that can be corrugated to increase its rigidity.

The U.S. Pat. No. 3,187,798 discloses a radiant gas burner for use with a pressurized combustible mixture of gaseous fuel and air.

The U.S. Pat. No. 4,669,974 discloses a fuel combustion apparatus in which liquid fuel is vaporized.

SUMMARY OF THE INVENTION

Therefore the technical task of the present invention is to improve the prior art.

Within the scope of such technical task, it is an object of the present invention to provide a tubular radiant element with larger radiant surface compared to the tubes known in the field.

A further object of the present invention consists in providing a tubular radiant element more resistant to the mechanical and heat stresses it is subject to. This task and this object are achieved by a tubular radiant element according to the present description.

The particular shape of the tubular radiant element according to the present invention allows obtaining a better irradiation, both in quantitative terms and as far as the treatment homogeneity is concerned, as well as a higher resistance and duration, compared to the tubes of the prior art.

Moreover, the tubular radiant element according to the invention could allow limiting the harmful emissions caused by the same combustion, thus ensuring a more eco-friendly product compared to the products used on the market so far.

Further advantageous features are described herein.

BRIEF DESCRIPTION OF THE DRAWINGS

The features of the invention shall be better understood by any man skilled in the art from the following description and annexed drawing tables, provided by way of a non-limiting example, wherein.

DETAILED DESCRIPTION OF PREFERRED EMBODIMENTS

Figure 1:
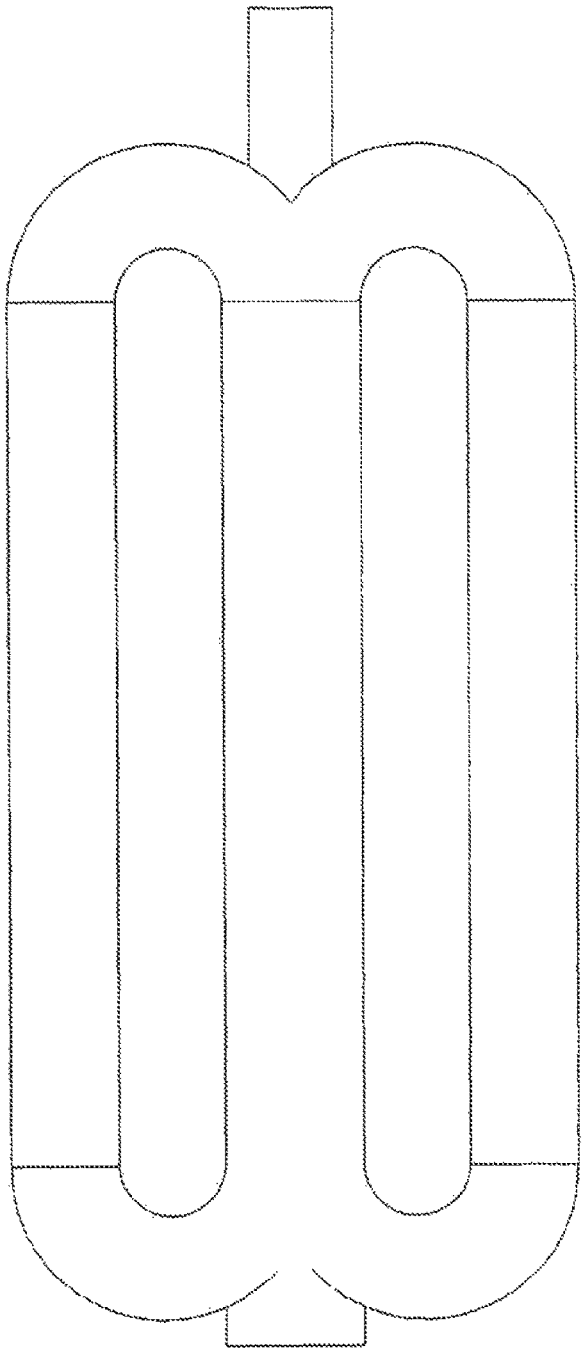
FIG.1 PRIOR ART
FIG. 1 is a front view of a known radiant tube.

With reference to the annexed FIG. 1, a known radiant tube is shown, the outer and inner surfaces whereof are smooth and continuous in all the portions of the same tube.

Figure 2:
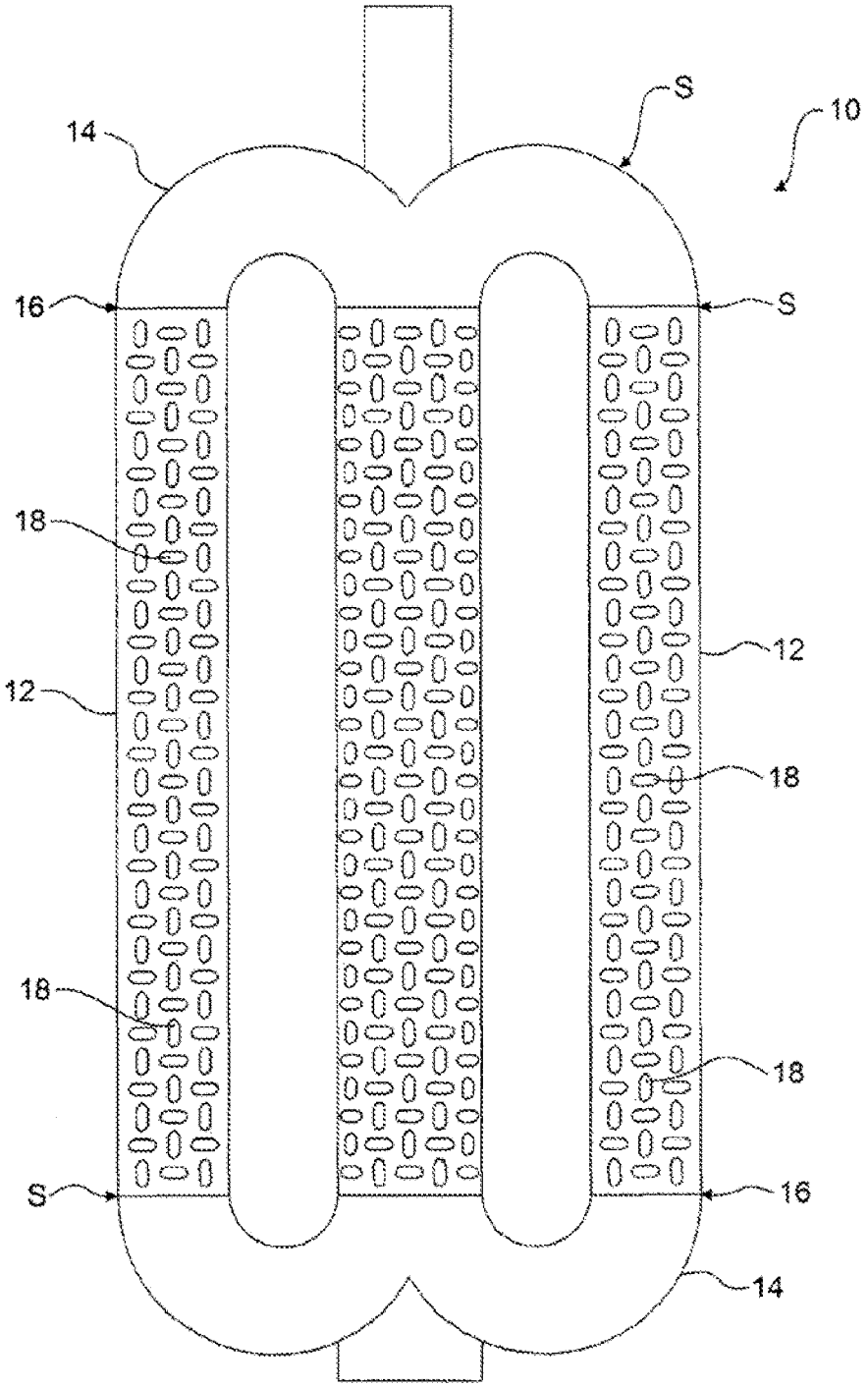
FIG. 2 is a front view of a tubular radiant element according to the present invention.

With reference to FIG. 2, on the other hand, a tubular radiant element globally indicated with reference numeral 10 is shown, according to the present invention.

The tubular radiant element 10 may comprise at least one vertical tubular portion 12, optionally at least one curved tubular portion 14 and at least one union element 16.

The at least one union element 16, optionally shaped as known welds and/or joints, connects and combines together the at least one vertical tubular portion 12 with the optional at least one curved tubular portion 14 and/or with other devices or portions required for the operation thereof.

The tubular radiant element 10 may be shaped as a "double U", "W" or "M", single "P", "double P", double "M" or may have any other shape suitable for the purpose.

By way of a non-limiting example only, the annexed figures show a tubular radiant element 10 shaped as a "double P".

Each portion 12, 14 of the tubular radiant element 10 has a substantially circular section but it may also have other types of section, without departing from the scope of protection of the present invention, such as an oval, rectangular, square, polygonal section, et cetera.

The tubular radiant element 10 may be made of a metal material resistant to high temperatures, optionally as metal alloys, in particular capable of resisting at least up to 1300° C., such as: nickel and chromium alloys, for example Inconel 600, 601 or 602, Incoloy 800, Incoloy 800H, AISI304, 310, 309, 309S, 316, 316Ti, 330, 321, AVESTA235MA, ALUFER, ALLOY X, Kanthal materials such as APM, APMT, et cetera, Mitsubishi materials such as MA230, MA250, et cetera, cast-iron Ni-resist or other cast iron derivatives, molten metal materials with or without nickel, chromium, aluminium components et cetera, such as Gx40CrNi 26-20, KHR48N, KHR35H, et cetera, and/or other materials suitable for the purpose.

The tubular radiant element 10 is obtained by cutting, calendaring, forming, pressing and welding of the sheet and/or rolled sections, and/or through melting and/or forging and/or extrusion, et cetera, according to the material used.

The tubular radiant element has a thickness of about 0.5-14 mm depending on the material it is made of, for example a thickness from 0.5 mm to 14 mm for tubular radiant elements made of sheet and/or rolled sections and a thickness from 6 mm to 14 mm for tubular radiant elements made through melting, forging, extrusion, et cetera.

The tubular radiant element 10 comprises at least one radiation and stiffening element 18. In particular, the tubular radiant element 10 comprises a plurality of radiation and stiffening means 18, provided on at least a portion of the surface S of the tubular radiant element 10.

The at least one radiation and stiffening means 18 may be provided on at least a portion of the vertical tubular portions 12 and/or on at least a portion of the curved tubular portions 14 and/or on the entire surface S of the same tubular radiant element 10.

In one version of the invention, the at least one radiation and stiffening means 18 is provided in at least some of the portions of the tubular radiant element 10 not directly contacting the flame coming from the burner.

Figure 6:
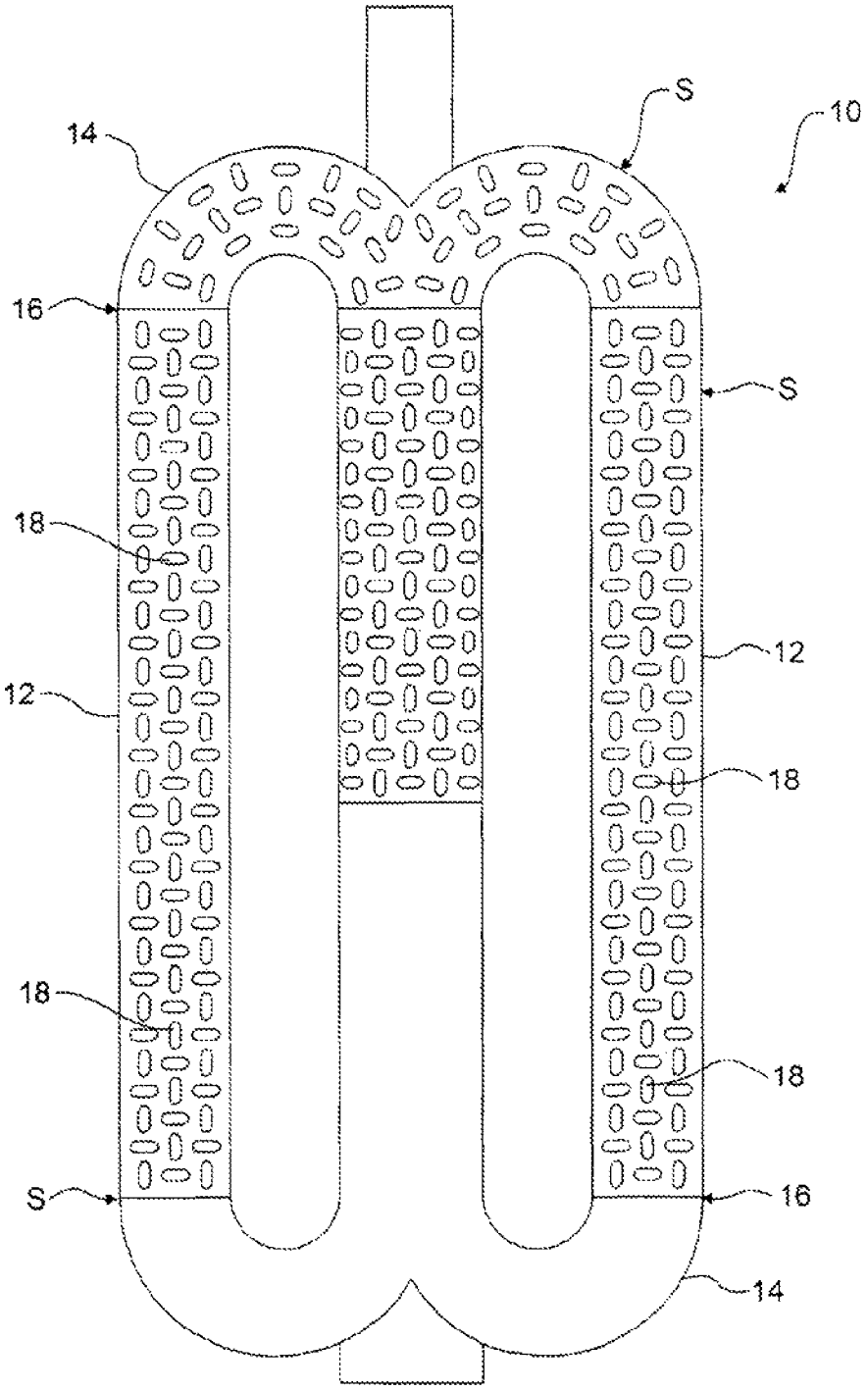
FIG. 6 is a front view of a version of the tubular radiant element according to the present invention.

By way of a non-limiting example, shown in FIG. 6, the tubular radiating element 10 has a central vertical tubular portion 12 provided with a smooth surface in the bottom portion, connected to the burner and reached by the flame coming from the same, and a top portion, not reached by the burner flame but only by the combustion fumes, provided with at least one radiation and stiffening element 18.

In one version of the invention, the central vertical tubular portion 12 does not exhibit radiation and stiffening elements 18.

The at least one radiation and stiffening means 18 is provided in the zones of the tubular radiant element where it is necessary to have a larger radiant surface and/or a better stiffening of the structure thereof, while optionally preventing the forming of possible turbulences or vortices in the hottest portions of the same or in the portions closer to the burner.

The at least one radiation and stiffening means 18 allows obtaining a series of advantages related to the radiant capabilities of the tubular radiant element 10, such as: a greater heat radiation efficiency, an increase of the overall radiant surface, a better heat radiation evenness, consequently achieving a product of steel and/or other metals treated in a better way and therefore with better properties.

The at least one radiation and stiffening means 18 further allows obtaining a series of advantages related to the stiffness of the tubular radiant element, such as: lower deformation over time, longer duration over greater absorption of the mechanical waves generated by the connected burner, and by the same operation of the tubular element, which cause mechanical stress to the same tubular radiant element 10 causing the breakage or twisting thereof, less elongation of the same tubular radiant element 10 by deformation and/or a more adequate elongation, higher resistance to heating and cooling thermal shocks which cause changes in temperature between 600° C. and 1300° C., et cetera.

Moreover, thanks to the presence of the at least one radiation and stiffening means 18, it may be possible to obtain a better flame vortex within the tubular radiant element 10, which may cause an acceleration of the resulting fumes. In this way it could be possible to obtain a shorter ignition time of the burner, while reducing the consumptions related thereto. Such speeding up of the fumes may cause a greater combustion in the return step of the same, with consequent reduction of the emission of harmful substances, such as nitrogen oxides and mixtures thereof.

The at least one radiation and stiffening means 18 may comprise an indentation and/or a protrusion and/or a corrugation and/or a coupling and/or a ribbing and/or a channel, et cetera, projecting inside and/or outside relative to surface S of the tubular radiant element 10 and/or a reticular element and/or any other element capable of increasing the radiant surface and the stiffening of the same tubular radiant element 10.

The at least one radiation and stiffening element has any geometrical shape, for example spheroid, cap, ovoid, ellipsoidal, annular, parallelepiped, cubic, polyhedral, prismatic, pyramid, conical, linear, et cetera, a plan and/or section configuration of any shape, for example rectangular, square, oval, ellipsoidal, helical, circular, polygonal, reticular, with rounded edges, et cetera.

The at least one radiation and stiffening means 18 may be obtained by processing the material that constitutes the tubular radiant element 10, such as the moulding of the same on a special mould or the pressing by special presses or other equipment suitable for the purpose.

Figure 4:
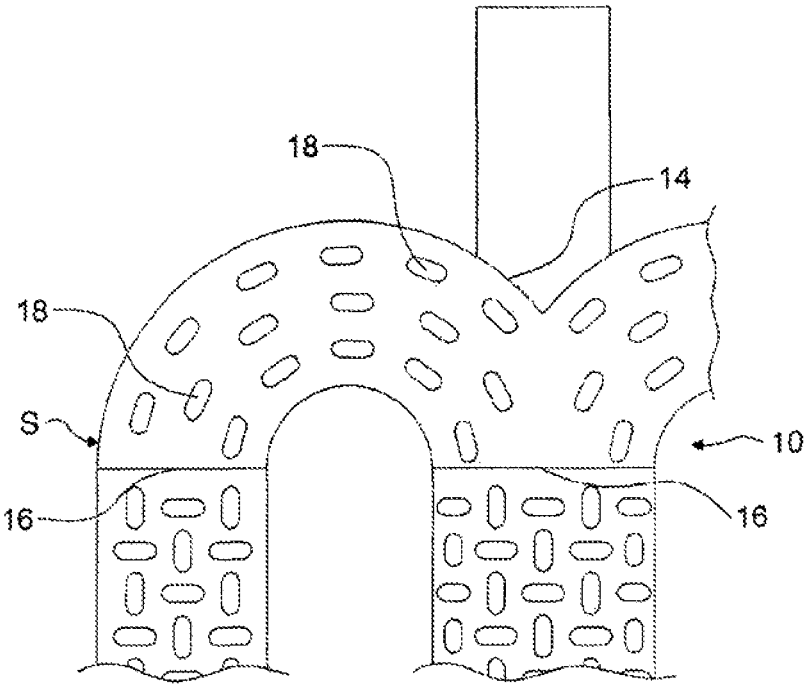
FIG. 4 shows a detail of a version of the radiant element according to the present invention.
Figure 5:
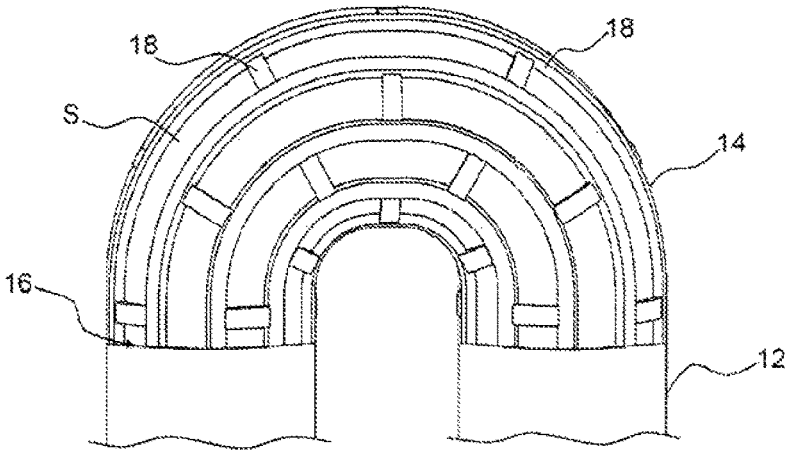
FIG. 5 shows a detail of a further version of the tubular radiant element according to the present invention.

In one version of the invention, visible in the FIGS. 4 and 5, the at least one radiation and stiffening means 18 may comprise means already formed obtained by moulding and/or forming of the sheet and/or rolled sections and/or melting of any type and/or pressure melting or any other method implying the realisation of structures projecting relative to surface S of the tubular radiant element 10.

Such at least one radiation and stiffening means 18 comprising means already formed may subsequently be applied to the tubular radiant element 10, for example by welding or other methods suitable for the purpose. In this way, in fact, the radiation surface of the tubular radiant element 10 is increased and at the same time, the structure thereof is stiffened, making it more resistant to the mechanical and dynamic stresses, for example given by the vibrations imparted by the burner.

Figure 7:
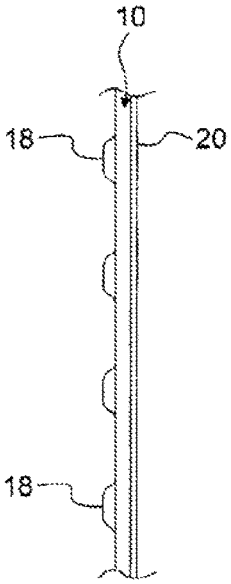
FIG. 7 is a cutaway view of a detail of a version of the tubular radiant element according to the present invention.
Figure 10:
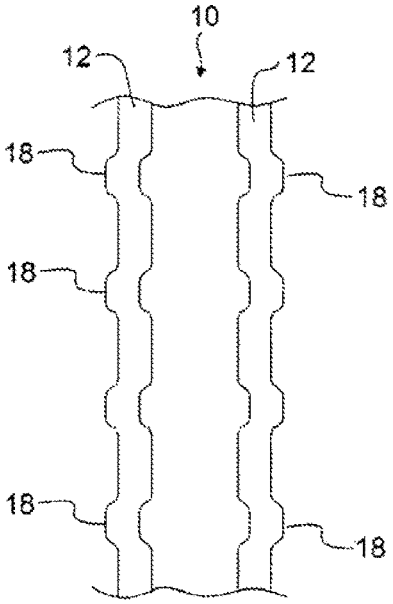
FIG. 10 is a cutaway view of a detail of the tubular radiant element according to the present invention.
Figure 8:
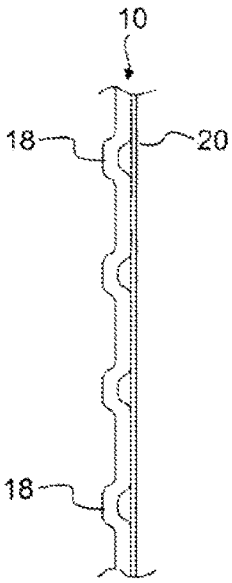
FIG. 8 is a cutaway view of a detail of a further version of the tubular radiant element according to the present invention.

In yet a further version of the invention, visible in FIG. 7 or 8, the at least one radiation and stiffening means 18, projecting outwards, may correspondingly be provided with a coating layer 20. Such coating layer 20 has a substantially even thickness of at least 0.2 mm and preferably ranging between 0.2 mm and 10 mm. Such coating layer 20 is arranged within at least one portion of the tubular radiant element 10, has a substantially tubular shape or corresponding to that of the portion of the tubular radiant element 10 in which it is arranged and has a surface substantially smooth and continuous.

In a further version of the invention (not shown) the surface of the coating layer 20 has corrugations and/or a non smooth shape.

Such coating layer 20 may be made of the same material that constitutes the tubular radiant element 10 or another material resistant to high temperatures and suitable for the purpose.

The at least one radiation and stiffening means 18 may exhibit any dimension. In particular, the dimensions of the at least one radiation and stiffening means 18 may range, for the larger dimension, between 0.2 mm and the entire length and/or circumference and/or perimeter of the tubular radiant element 10 whereon they are made, and for the smaller dimension, between 0.2 mm and 200 mm.

In one version of the invention, the dimensions of the at least one radiation and stiffening means 18 are comprised, for the larger dimension, between 2 cm and 10 cm and for the smaller dimension, between 2 cm and 4 cm.

The at least one radiation and stiffening means 18 projects relative to surface S of the tubular radiant element 10 by about 0.1 cm-10 cm.

In one version of the invention, the projection dimensions of the at least one radiation and stiffening means 18 range between 0.5 cm and 1 cm.

Such at least one radiation and stiffening means 18 made be made of the same materials that constitute the tubular radiant element 10 or other similar materials suitable for the purpose.

Such at least one radiation and stiffening means exhibits a predetermined arrangement and shape so that the end result exhibits the desired features of stiffening and increase of the radiation surface. In particular, the forming of the at least one radiation and stiffening means 18 is prevented from causing the forming of undesired cracks, slits and/or deformations which could weaken the overall structure of the tubular radiant element 10 itself.

Figure 3:
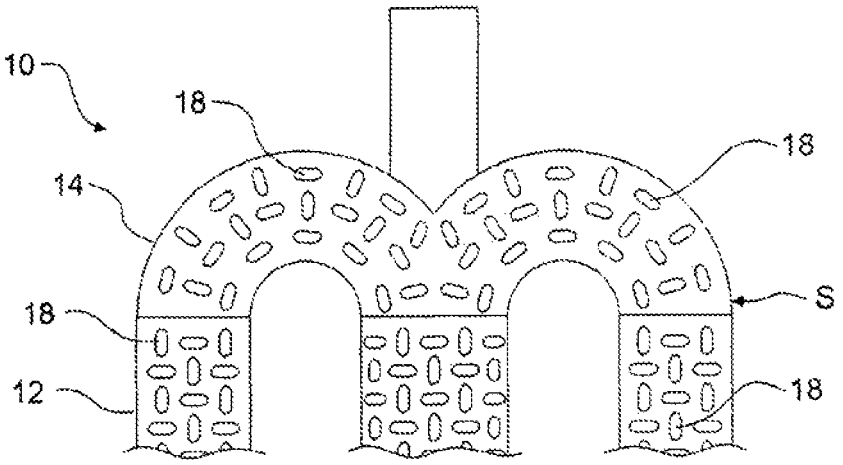
FIG. 3 is a front view of a detail of the tubular radiant element of FIG. 2.

In a non-limiting exemplary embodiment of the invention, outside surface S of the tubular radiant element 10 there is a plurality of radiation and stiffening means 18 arranged according to a circular arrangement and/or into substantially linear lines and columns, spacing out a means arranged in vertical direction with a means arranged in horizontal direction, as seen in FIGS. 2 and 3, or the radiation and stiffening means 18 may be arranged into lines with a substantially parallel pattern, as seen in FIG. 4, or they may be arranged in a reticulated shape, with meshes of any shape and dimension, of which an example is shown in FIG. 5, et cetera.

Figure 9:
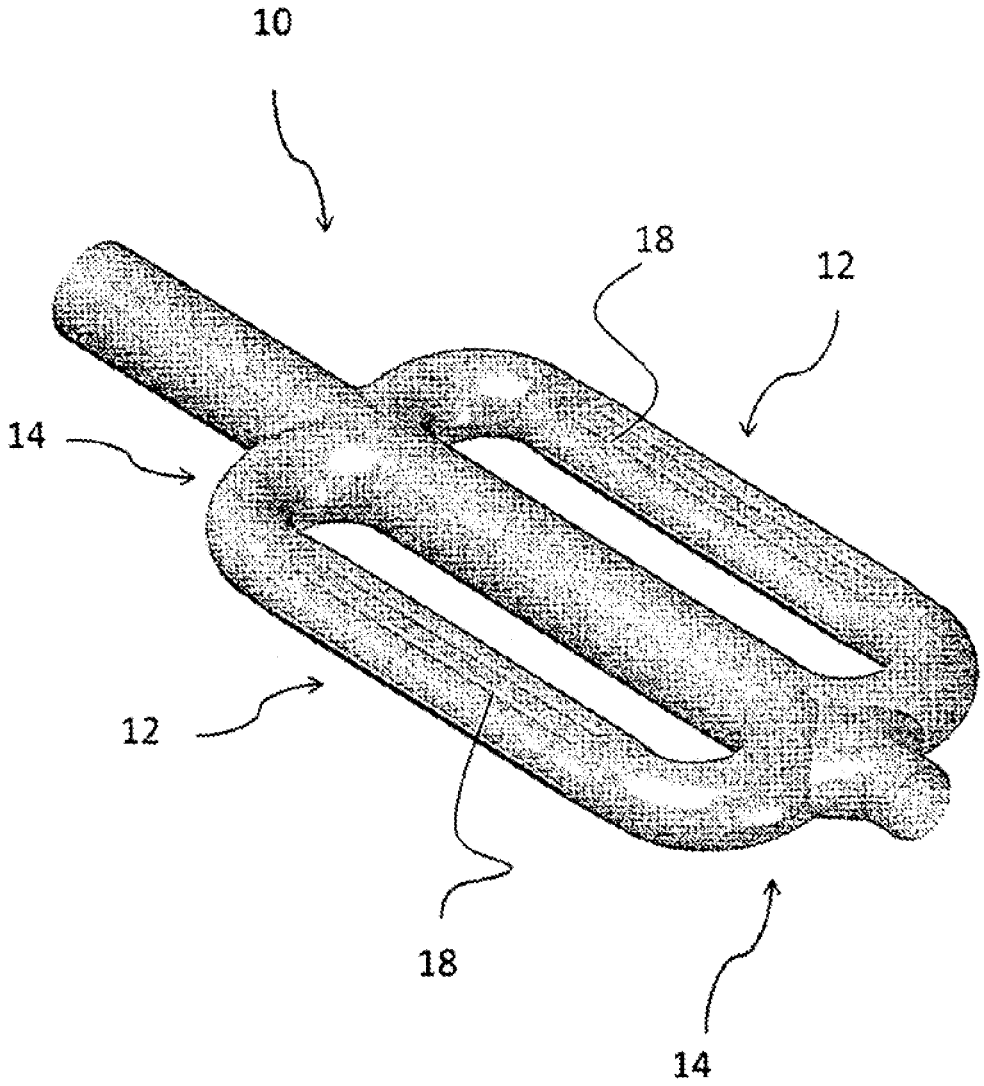
FIG. 9 is a perspective view of still a further version of the present invention.

The plurality of radiation and stiffening means 18 may also exhibit other arrangements, without departing from the scope of protection of the present invention. FIG. 9 shows a further version of the invention wherein the tubular radiant element 10 is shaped, by way of a non-limiting example only, as a "double P". The tubular radiant element 10 comprises a central vertical tubular portion 12 substantially with a circular section and two vertical side tubular portions with substantially oval section. The larger portion of the vertical tubular portions with oval section faces the product to be treated, so as to have a larger radiation surface.

On such vertical side tubular portions there is at least one radiation and stiffening element 18 substantially shaped as a channel or ribbing, arranged according to the longitudinal axis of the same tubular portion and with length substantially equal to that of the latter.

Generally, in one embodiment, the at least one radiation and stiffening means 18 causes a thickness variation, positive or negative, compared with the thickness of the tubular radiant element 10, by about 10%.

By way of a non-limiting example only, below are some examples of the increase of the radiant surface of tubular radiant elements 10 provided with a plurality of radiation and stiffening means 18.

EXAMPLE 1

The increase of radiant surface on the vertical side tubular portions 12 is equal to about 13256 $mm^2$ thanks to the presence of 94 radiation and stiffening means 18 in vertical position, and 95 radiation and stiffening means 18 in horizontal position.

EXAMPLE 2

The increase of radiant surface on the central vertical tubular portion 12, having a larger diameter than the side ones, is equal to 26460 $mm^2$ thanks to the presence of 189 radiation and stiffening means 18 in vertical position, and 189 radiation and stiffening means 18 in horizontal position.

EXAMPLE 3

The increase of radiant surface on the curved tubular portion 14 is equal to about 5320 $mm^2$ thanks to the presence of 38 radiation and stiffening means 18 in vertical position, and 38 radiation and stiffening means 18 in a horizontal position.

It has thus been observed that the invention achieves the intended objects.

The present invention has been described according to preferred embodiments but equivalent versions may be conceived without departing from the scope of protection offered by the following claims.

The invention claimed is:

1. A tubular radiant element for industrial plants for heat treatments of steel and/or other metals, comprising:

at least a central vertical tubular portion having a top portion and a bottom portion and two side vertical tubular portions, wherein said central and two side vertical tubular portions are all connected by upper and lower curved tubular portions, all of said portions having circular sections and provided with a surface (S) of said circular sections;

a plurality of radiation and stiffening means comprising a plurality of protrusions;

wherein the tubular radiant element is comprised of a metal material resistant to high temperatures at least up to 1300° C., wherein said protrusions are provided on:

the top portion of the central vertical tubular portion and each of said side vertical tubular portions, and on at least a portion of said upper curved tubular portions, the central vertical portion comprising a smooth surface in the bottom portion, wherein all the plurality of protrusions are arranged on and project radially outwards from said surface of said circular sections to prevent the forming of turbulences or vortices in the hottest portions of the tubular radiant element, wherein said plurality of protrusions do not contact each other and are arranged into substantially linear lines and columns spaced from each other, spacing out a means arranged in vertical direction with a means arranged in horizontal direction, wherein said protrusions have a length of between 2 cm and 10 cm and a width of between 2 cm and 4 cm, and wherein said protrusions project relative to said surface (S) from about 0.5 cm to about 1 cm, wherein each of said plurality of protrusions has a pyramidal three-dimensional shape.

2. The tubular radiant element according to claim 1, wherein said plurality of radiation and stiffening means is obtained by processing the material that constitutes said tubular radiant element, including the moulding of the same on a special mould or the pressing by special presses or other equipment suitable for the purpose.

3. The tubular radiant element according to claim 1, wherein said plurality of radiation and stiffening means is made of a metal material resistant to high temperatures, or alloys thereof, including nickel and chromium alloys, Inconel 600, 601 or 602, Incoloy 800, Incoloy 800H, stainless steel AISI304, 310, 309, 309S, 316, 316Ti, 330, 321, AVESTA235MA, ALUFER, ALLOY X, Kanthal materials such as APM, APMT, Mitsubishi materials such as MA230, MA250, cast iron Ni-resist or other cast iron derivatives, molten metal materials with or without nickel components, chromium, aluminium, such as Gx40CrNi 26-20, KHR48N, KHR35H, and/or other metal or non metal materials suitable for the purpose.

4. The tubular radiant element according to claim 1, comprising a coating layer at said plurality of radiation and stiffening means.

5. The tubular radiant element according to claim 4, wherein said coating layer has an even thickness of at least 0.2 mm.

6. The tubular radiant element according to claim 4, wherein said coating layer is arranged within the tubular radiant element, has a tubular shape or corresponding to the tubular element wherein it is inserted and exhibits a substantially smooth and continuous or corrugated surface.

7. The tubular radiant element according to claim 1, wherein said tubular radiant element has a thickness of about 0.5-14 mm depending on the material it is made of.

8. The tubular radiant element of claim 1, wherein the bottom portion of the central vertical tubular portion is configured for connection to a burner and the top portion of the central vertical tubular portion is not reached by a burner flame.

* * * * *